US006665413B1

(12) United States Patent
Domen

(10) Patent No.: US 6,665,413 B1
(45) Date of Patent: Dec. 16, 2003

(54) INFRASONIC HELMHOLTZ RESONATOR

(75) Inventor: John K. Domen, Succasunna, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/064,492

(22) Filed: Jul. 22, 2002

(51) Int. Cl.[7] ..... H04R 25/00

(52) U.S. Cl. ..... 381/349; 381/350; 381/351; 381/345; 381/346; 181/156

(58) Field of Search ..... 381/349, 350, 381/351, 345, 346, 347, 348; 181/156

(56) References Cited

U.S. PATENT DOCUMENTS 4,180,140 A * 12/1979 Marshall
5,875,255 A * 2/1999 Campbell
6,223,853 B1 * 5/2001 Huon et al.

* cited by examiner

*Primary Examiner*—Curtis Kuntz
*Assistant Examiner*—Tuân D Nguyêñ
(74) *Attorney, Agent, or Firm*—Michael C. Sachs; John F. Moran

(57) ABSTRACT

An infrasonic Helmholtz resonator capable of producing clean sinusoidal frequencies in the range of 6–14 Hz is described.

12 Claims, 2 Drawing Sheets

INFRASONIC HELMHOLTZ RESONATOR

FEDERAL RESEARCH STATEMENT

The invention described herein may be made, used, or licensed by or for the U.S. Government for U.S. Government purposes.

BACKGROUND OF INVENTION

Heretofore, the generation of clean signals in the acoustic range of 6–20 Hz. has not been attainable by any of the commercially known systems. Thus, for example, systems employed for generating power in the audible acoustic range as described herein have operated on different physical principles. For example, a typical commercial product known as a hydrosonic subwoofer is disclosed in U.S. Pat. No. 5,281,777. This device includes a fluid damped acoustic enclosure system for a loudspeaker having an enclosure which defines first and second chambers separated by a common wall in which a loudspeaker is sealably mounted. In the operation of the device, a flexible bladder is filled with a fluid and maintained in the first chamber a given distance above the loudspeaker. The flexible bladder receives acoustic pressure waves generated by the loudspeaker. The bladder is mechanically coupled to a portion of at least one wall of the first chamber that communicates with the exterior of tie enclosure.

In this prior art system, the fluid damped enclosure system causes bags of water and a flexible wall to vibrate mechanically at low frequency. In this manner, sound waves are coupled to relatively rigid radiating surfaces and, simultaneously, a portion of each pressure wave is reflected back toward its source, so causing a reflective damping system.

A review of this system reveals that it is a driven damped harmonic oscillator system wherein bags of water and a flexible plate and their boundary containment evidence a spring constant and damping factor.

An alternative system comprises a large mechanical piston that adiabatically compresses, air in a room without any concept of resonance.

SUMMARY OF INVENTION

This invention relates to an infrasonic sound power source. More specifically, the present invention relates to a portable, efficient power source of infrasonic sound within the range of 6–20 Hz, without generating spurious frequencies, using a Helmholtz resonator.

BRIEF DESCRIPTION OF DRAWINGS

The invention will be more fully understood by reference to the following detailed description taken in conjunction with the accompanying drawing wherein.

DETAILED DESCRIPTION

Figure 1:
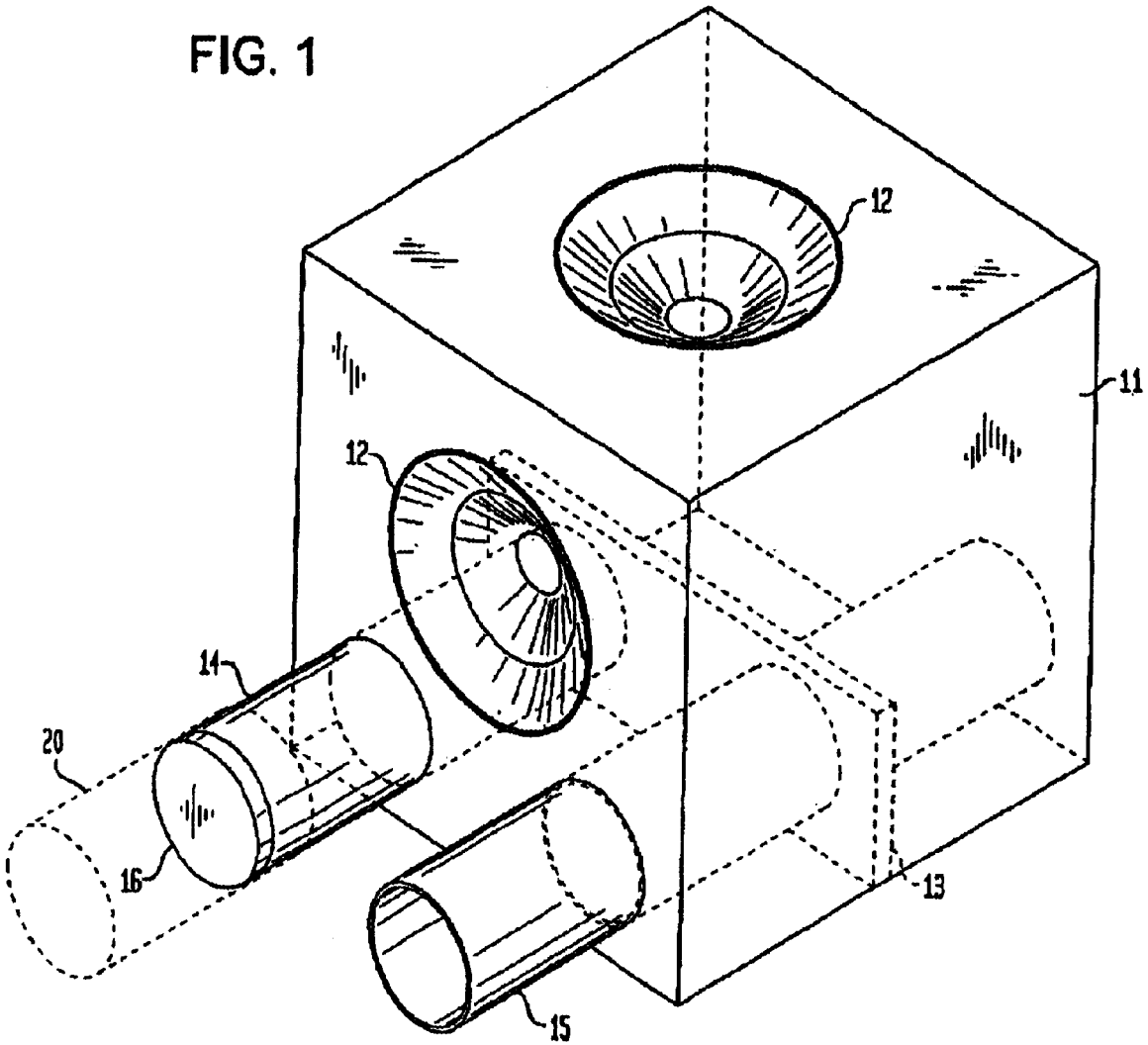
FIG. 1 is a perspective view of an infrasonic sound generator in accordance with the invention.

With reference now to FIG. 1, there is shown a non-cubical plywood box 11 having disposed therein one or more low frequency commercial speakers 12. Box 11 includes an internal baffle 13 which prevents high frequency resonances, external diameter ports (vents) 14 of a length of 9.5 inches and 15 of a length of 36 inches, port 14 being tuned at 14.2 Hz but tunable down to 9.0 Hz by adding tight fitting lengths or extensions 20 (shown in dashed lines) to the outside of the port. Port 15 is tuned to 8.3 Hz and with the addition of external lengths may be tuned down to 6 Hz. In operation, one vent is closed by means of air tight cap 16.

The air inside box 11 is made to resonate at the Helmholtz frequency in accordance with the following equation:

$$\text{Hz (Helmholtz frequency)}=C*[SQRT(S/((L+X)*V))]/(2*pi)$$

wherein C=sound speed, S=vent area, L=vent length, X=1.5*R for a vent which has no flange at the outer opening, R=vent radius, and V=box volume.

Thus, for a box with V=27 cubic feet, R=3 inches, L=36 inches and C=1128 ft/sec, the Helmholtz resonant frequency is 8.3 Hz.

The described box attempts to use a vented box to utilize a single very low frequency output (within the range of 8–15 Hz) of the 18" Electro-Voice EVX-180B speaker-driver. The driver frequency response is listed at 20–2000 Hz, with a Qts of 0.266 and a free air resonance frequency of Fs=29 Hz.

Since the system operates on the decreasing dB low frequency slope of the amplitude response, the speaker front output and back output will not be in phase, and some signal cancellation is expected.

As noted, the box design had an inside volume of 27 cubic feet. Two vents each 6" in diameter were provided comprising polyvinylchloride pipe. This design was chosen to achieve a convenient large volume, minimal excursion of driver cone, minimal air velocity through the 2 initial vents which can be extended externally to achieve a discrete spread in tuned resonant frequencies from the box. A cube was not chosen so resonant frequencies off opposite walls would not be the same.

Two vents were provided. The left vent was set for 14.2 Hz and the right for 8.3 Hz. To decrease the Helmholtz resonant frequency of the box, with an internal volume of 27 cubic feet, the addition of tight fitting lengths the outside port decreases the frequency accordingly. The parameters of the vents were as follows:

Left Vent: Initial length 9.5", Freq. 14.2 Hz

| Additional Length (inches) | Frequency |
|---|---|
| 2.6 | 13 |
| 5.5 | 12 |
| 9.2 | 11 |
| 14.1 | 10 |
| 20.7 | 9 |

Right Vent: Initial Length: 36", Freq. 8.3 Hz

| Additional Length | Frequency |
|---|---|
| 3.4 | 8.0 |
| 16.8 | 7.0 |
| 37.0 | 6.0 |

In order to evaluate the aforementioned system, it was placed in a room having an opening of approximately 3 square feet. With the speaker operating at a frequency of 8 Hz or 14 Hz, and with the Helmholtz resonator tuned to those frequencies at a few watts of power, a 118 dB level was measured in the room with a calibrated microphone. With the room closed and the speaker operating near but not at maximum power, the dB was in the 130 range. Finite element engineering computer program calculations revealed that at these low frequencies, the dB level is essentially constant throughout the room volume at any time. Experimentally, the low frequencies propagated outside the room, especially at the higher dB level.

The described system is unique in that it employs a Helmholtz resonance principle in conjunction with a vibrating membrane (one or several low frequency commercial speakers and/or large area mechanical vibrators) which moves the air in the box at a given low frequency. The speakers or mechanical vibrators are mounted in the walls of the box which is airtight. The only external opening is through a vent port. Though the intensity of these vibrators is low, the box in which they are positioned is tuned to resonate at the box Helmholtz frequency. It is this resonance design of the box which greatly enhances the output of the mechanical vibrators, which output exits through the open port.

To effect a change in frequency, it is necessary to change the mechanical vibrator to the desired frequency and tune the Helmholtz box resonator to the desired frequency by changing the pipe length from the box. Commercial speakers in this frequency range operate on the decreasing dB low frequency slope of their amplitude response and operate at very low power in this range as the speaker cone has a large excursion at law frequency operation. The commercial speaker operated at higher power in this frequency range would destroy the speaker cone. However, this limitation does not preclude Helmholtz amplification of the low output at these low frequencies.

Figure 2:
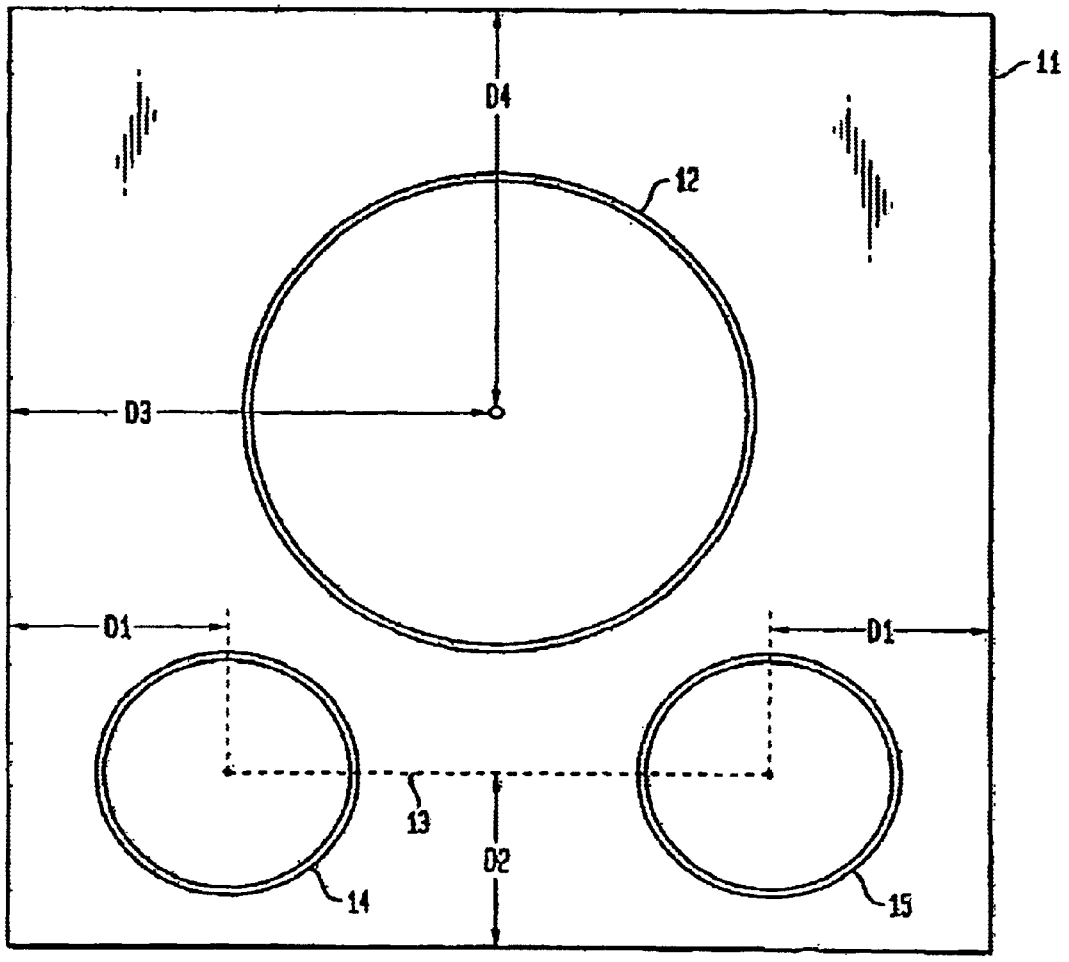
FIG. 2 is a front elevational view of the infrasonic sound generator shown in FIG. 1

FIG. 2 is a front elevational view of the infrasonic sound generator shown in FIG. 1. Shown in this Figure are speaker (s) or vibrator(s) 12, and ports or vents 14 and 15. The center of the right vent 15 is at a distance D1 of 6 inches from the box right wall 11. Similarly, the center of left vent 14 is at a distance D1 from the left wall. The centers of both 14 and 15 are at a distance D2 from the box bottom. The center of vibrator 12 is at a distance D3 of 17.5 inches from the left wall, and at a distance D4 of 16 inches from the top of the box.

While the invention has been described in detail in the foregoing specification, it will be understood by those skilled in the art that variations may be made by one skilled in the art without departing from the spirit and scope of the invention. Thus, for example, the described concept is applicable to frequencies higher than 20 Hz and lower than 6 Hz by alterations of the basic design involving the Helmholtz equation and by keeping the air velocity through the ports low enough to prevent turbulence by maintaining port diameters that are sufficiently large.

What is claimed is:

1. An infrasonic sound power generator for producing clean sinusoidal signals in an audible range of 6 to 20 Hz, comprising:

a container;

at least one vibrator disposed within the container;

an internal baffle disposed within the container;

a first vent and a second vent secured to the container and extending outside the container;

the first vent having a variable length and being tunable to a desired frequency by adding an extension;

at least one of the first vent or the second vent being closed by a cap; and wherein air inside the container resonates at a Helmholtz frequency in accordance with the following equation:

$$Hz\ (\text{Helmholtz frequency})=C*[SQRT(S/((L+X)*V))]/(2*pi),$$

where C represents the speed of sound, S represents a vent area, L represents a vent length, R represents a vent radius, X represents 1.5*R, and V represents a container volume.

2. The infrasonic sound power generator of claim 1, wherein the first vent a length of 9.5 inches.

3. The infrasonic sound power generator of claim 2, wherein the second vent a length of 36 inches.

4. The infrasonic sound power generator of claim 3, wherein the first port is tunable over a range of approximately 14.2 Hz to 9.0 Hz.

5. The infrasonic sound power generator of claim 4, wherein the second port is tunable over a range of approximately 8.3 Hz to 6 Hz.

6. The infrasonic sound power generator of claim 5, wherein the at least one vibrator comprises at least one low frequency speaker.

7. A speaker system for producing infrasonic sound in a range of 6 to 20Hz, comprising:

a container;

at least one vibrator disposed within the container;

an internal baffle disposed within the container;

a first vent and a second vent secured to the container and extending outside the container;

the first vent having a variable length and being tunable to a desired frequency by adding an extension;

at least one of the first vent or the second vent being closed by a cap; and wherein air inside the container resonates at a Helmholtz frequency in accordance with the following equation:

$$Hz(\text{Helmholtz frequency})=C*[SQRT(S/((L+X)*V))]/(2*pi),$$

where C represents the speed of sound, S represents a vent area, L represents a vent length, R represents a vent radius, X represents 1.5*R, and V represents a container volume.

8. The speaker system of claim 7, wherein the first vent a length of 9.5 inches.

9. The speaker system of claim 8, wherein the second vent a length of 36 inches.

10. The speaker system of claim 9, wherein the first port is tunable over a range of approximately 14.2 Hz to 9.0 Hz.

11. The speaker system of claim 10, wherein the second port is tunable over a range of approximately 8.3 Hz to 6 Hz.

12. The speaker system of claim 11, wherein the at least one vibrator comprises at least one low frequency speaker.

* * * * *